US010835044B2

(12) United States Patent
Tang

(10) Patent No.: US 10,835,044 B2
(45) Date of Patent: Nov. 17, 2020

(54) FOLDING STORAGE STOOL ON WHEELS

(71) Applicant: WUXI HOUSETEX INDUSTRIES CO., LTD, Jiangsu (CN)

(72) Inventor: Hongyan Tang, Jiangsu (CN)

(73) Assignee: WUXI HOUSETEX INDUSTRIES CO., LTD., Wuxi (CN)

( * ) Notice: Subject to any disclaimer, the term of this patent is extended or adjusted under 35 U.S.C. 154(b) by 79 days.

(21) Appl. No.: 16/257,298

(22) Filed: Jan. 25, 2019

(65) Prior Publication Data

US 2019/0167005 A1 Jun. 6, 2019

Related U.S. Application Data

(63) Continuation-in-part of application No. PCT/CN2016/093953, filed on Aug. 8, 2016.

(51) Int. Cl.

| | |
|---|---|
| ***A47C 4/04*** | (2006.01) |
| ***A47C 4/02*** | (2006.01) |
| ***A47C 7/62*** | (2006.01) |
| ***A47C 7/00*** | (2006.01) |
| ***A47C 7/02*** | (2006.01) |

(52) U.S. Cl.

CPC ..... *A47C 4/04* (2013.01); *A47C 4/02* (2013.01); *A47C 7/006* (2013.01); *A47C 7/021* (2013.01); *A47C 7/626* (2018.08); *A47C 7/628* (2018.08)

(58) Field of Classification Search

None

See application file for complete search history.

(56) References Cited

U.S. PATENT DOCUMENTS 3,639,942 A * 2/1972 Ostrom ..... B60B 33/0002 16/29
4,878,682 A * 11/1989 Lee ..... B62B 3/025 280/42
4,881,779 A * 11/1989 Bubien ..... A47C 4/021 297/440.13
4,974,870 A * 12/1990 Jarke ..... A47C 4/04 280/643

(Continued)

FOREIGN PATENT DOCUMENTS

CN 201664091 U 12/2010
CN 201840082 U 5/2011

(Continued)

*Primary Examiner* — David R Dunn
*Assistant Examiner* — Christopher E Veraa
(74) *Attorney, Agent, or Firm* — Wayne & Ken, LLC; Tony Hom

(57) ABSTRACT

A folding storage stool on wheels, including: a foldable stool body; a cover for covering an upper opening of the foldable stool body in an unfolded state; an inner support plate for supporting the foldable stool body and arranged on a bottom of an inner cavity of the unfolded stool body; and movable wheels arranged at a bottom of the unfolded stool body. Side folds are provided on middles of two opposite sides of the foldable stool body. A bottom fold that is inwardly folded is provided at a bottom surface of the foldable stool body. After the inner support plate is removed from the foldable stool body, the two opposite sides with side folds are folded inwardly along the side folds and the bottom surface is folded along the bottom fold, forming a folded body which is accommodated in a cavity of the cover.

14 Claims, 10 Drawing Sheets

(56) References Cited

U.S. PATENT DOCUMENTS

D341,556 S * 11/1993 Jarke ..... D12/128
5,257,707 A * 11/1993 Soede ..... B65D 7/26 206/597
5,273,307 A 12/1993 Jarke et al.
D344,915 S * 3/1994 Jarke ..... D12/128
5,310,208 A * 5/1994 Jarke ..... A47C 4/04 280/643
5,806,864 A * 9/1998 Zielinski ..... B62B 3/02 280/42
6,079,772 A * 6/2000 Green ..... A47C 4/08 297/16.1
7,562,897 B1 * 7/2009 Sherman ..... B62B 3/025 211/186
7,581,786 B1 * 9/2009 Wang ..... A47C 7/62 297/188.11
9,522,763 B2 * 12/2016 Roman ..... B62B 3/025
9,981,677 B1 * 5/2018 Gross ..... B62B 3/005
2003/0051311 A1 * 3/2003 Reilly ..... B60B 33/0057 16/44
2005/0204968 A1 * 9/2005 Butkus ..... A47B 3/12 108/157.14
2011/0146027 A1 * 6/2011 Tsai ..... B60B 33/0068 16/18 CG
2011/0162560 A1 * 7/2011 Tang ..... A47C 5/14 108/11
2012/0235370 A1 * 9/2012 Kirshner ..... B62B 3/02 280/30
2015/0076799 A1 * 3/2015 Ryan ..... B31B 50/26 280/651
2016/0121916 A1 * 5/2016 Kassab Arabo ..... B62B 3/00 280/37
2017/0347800 A1 * 12/2017 Tang ..... A47C 4/028

FOREIGN PATENT DOCUMENTS

CN 202173071 U 3/2012
CN 202723191 U 2/2013
CN 202941704 U 5/2013
CN 205053433 U 3/2016

* cited by examiner

FOLDING STORAGE STOOL ON WHEELS

CROSS-REFERENCE TO RELATED APPLICATIONS

This application is a continuation-in-part of International Application No. PCT/CN2016/093953, filed on Aug. 8, 2016, which is hereby incorporated by reference in its entirety.

TECHNICAL FIELD

The present disclosure relates to folding storage stools.

BACKGROUND OF THE INVENTION

Currently, in the field of household stools, most of the existing stools cannot be folded. A few folding stools are folded by connecting stool surface to stool legs by means of hinges. However, thus folded stools are still bulky and occupy a large space particular in height and length, which is not suitable for use, carrying and storage in the households with small spaces.

Many stools are equipped with movable wheels at the bottom. The movable wheels are mainly installed in two ways. One is to directly insert the movable wheels at the bottom of the stool; and the other is to fix the movable wheels to the stool by means of tools. The insertion requires specific inserting holes provided at the bottom of the stool resulting in unstable connection, and the movable wheels are easy to fall off. The fixed installation requires tools such as a screwdriver for assembly and disassembly, which is inconvenient to operate.

SUMMARY OF THE INVENTION

The present invention provides a folding storage stool on wheels to overcome the defects in the prior art. The folding storage stool on wheels is small in size and is easy to carry and store. Movable wheels arranged at the bottom of the stool facilitate the handling and movement of the stool.

A folding storage stool on wheels includes a foldable stool body, a cover for covering an upper opening of the foldable stool body in an unfolded state, an inner support plate for supporting the foldable stool body, which is arranged on a bottom of an inner cavity of the foldable stool body in an unfolded state, and a plurality of movable wheels arranged at a bottom of the foldable stool body in an unfolded state. A side fold is provided on a middle of each of two opposite sides of the foldable stool body. A bottom fold that is inwardly folded is provided at a bottom surface of the foldable stool body. After the inner support plate is removed from the foldable stool body, the two opposite sides with side folds are folded inwardly along the side folds and the bottom surface of the foldable stool body is folded along the bottom fold, so that a folded body is formed when two opposite sides without side folds are put together. The folded body and the inner support plate are accommodated in a cavity of the cover.

An outer support plate is arranged at the bottom of the foldable stool body in an unfolded state; the plurality of movable wheels are arranged on the outer support plate; and the outer support plate is fixedly connected to the inner support plate.

Further, the outer support plate is a one-piece square having a length and width greater than that of the bottom of the foldable stool in an unfolded body; or the outer support plate is a sectorial pad, and four sectorial pads are respectively provided at four corners of the bottom of the foldable stool body in a unfolded state; and the sectorial pad is provided with an L-shaped flanging partially abuts against a side of the bottom of the foldable stool body.

Each of the plurality of the movable wheels includes a wheel body and a wheel rod movably arranged on the wheel body. A plurality of mounting holes are positioned on the outer support plate and the inner support plate. The wheel rod is screwed into the mounting holes and connects the outer support plate and the inner support plate. A dial piece is fixedly arranged on the wheel rod so that the wheel rod is screwed onto the outer support plate or unscrewed from the outer support plate by means of the dial piece.

The movable wheel is also directly mounted on the inner support plate. The wheel rod passes through the bottom of the foldable stool body and is screwed onto the inner support plate so that the wheel rod is screwed onto the inner support or unscrewed from the inner support by means of the dial piece.

In order to easily operate the dial piece, both ends of the dial piece are respectively provided with a dial block bent toward the wheel body.

A frame is arranged in the foldable stool body, and a plurality of compartments are provided in the frame; an upper edge of the foldable stool body is provided with an adhesive strip to which a hook-and-loop fastener is attached; and the frame is fixed to the foldable stool body via the hook-and-loop fastener and the adhesive strip.

The benefits of the present invention are described below.

The foldable storage stool of the present invention can be used as both a stool and a storage box, which is useful and convenient. The foldable storage stool takes up less space and is easy to carry or store when folded because it is foldable. The stool on the bottom is equipped with movable wheels such that the stool is movable. The movable wheels are detachably connected to the foldable stool body in a screw connection, improving the stability and simplifying the installation at the same time. Such configuration eliminates the use of additional tools, and is convenient for disassembly of the inner support plate when folding the stool. The present invention has the advantages of simple structure and high practicability, which can be used in a wide range of applications.

Figure 1:
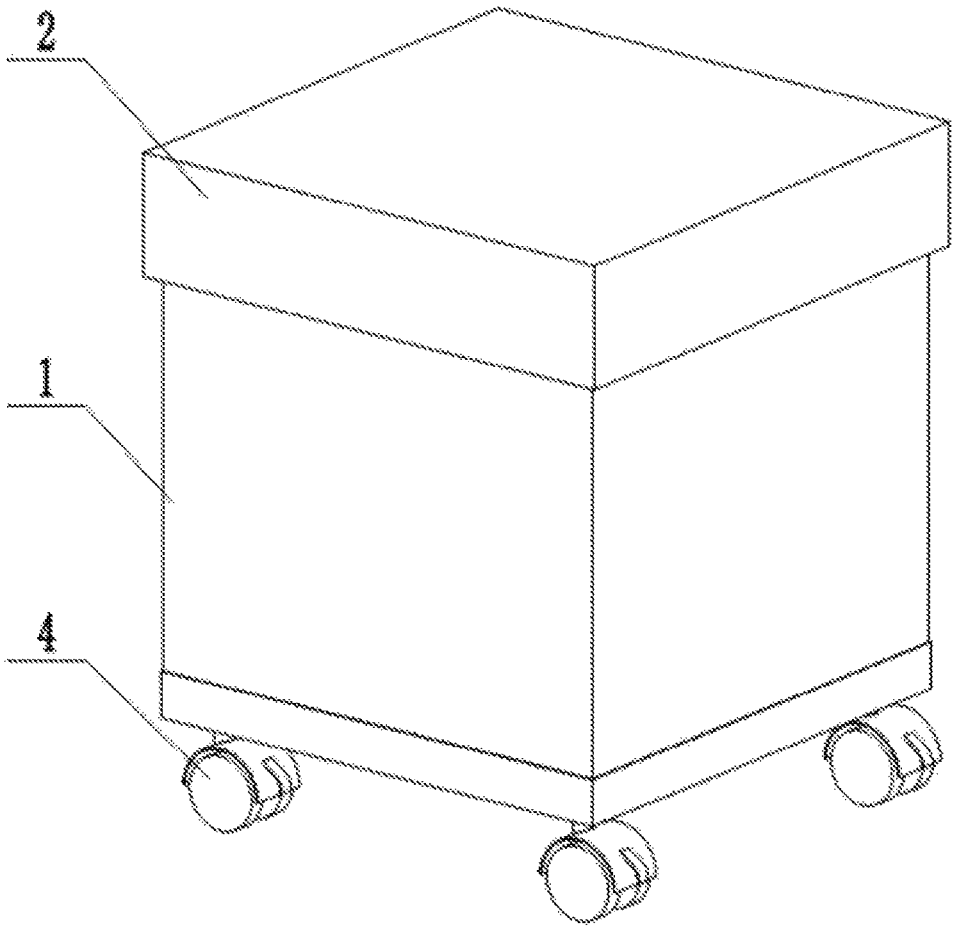
FIG. 1 is a view showing a folding storage stool in a use state according to the present invention.

In the drawings: 1, stool body; 101, side fold; 102, bottom fold; 2, cover; 3, inner support plate; 4, movable wheel; 41, wheel body; 42, wheel rod; 43, dial piece; 44, dial block; 45, polygonal gasket; 46, polygonal hole; 5, outer support plate; 51, sectorial pad; 511, L-shaped flanging; 6, mounting hole; 7, frame; 701, compartment; 8, adhesive strip.

DETAILED DESCRIPTION OF EMBODIMENTS

The embodiments of the present invention will be described in detail with reference to the drawings.

Figure 4:
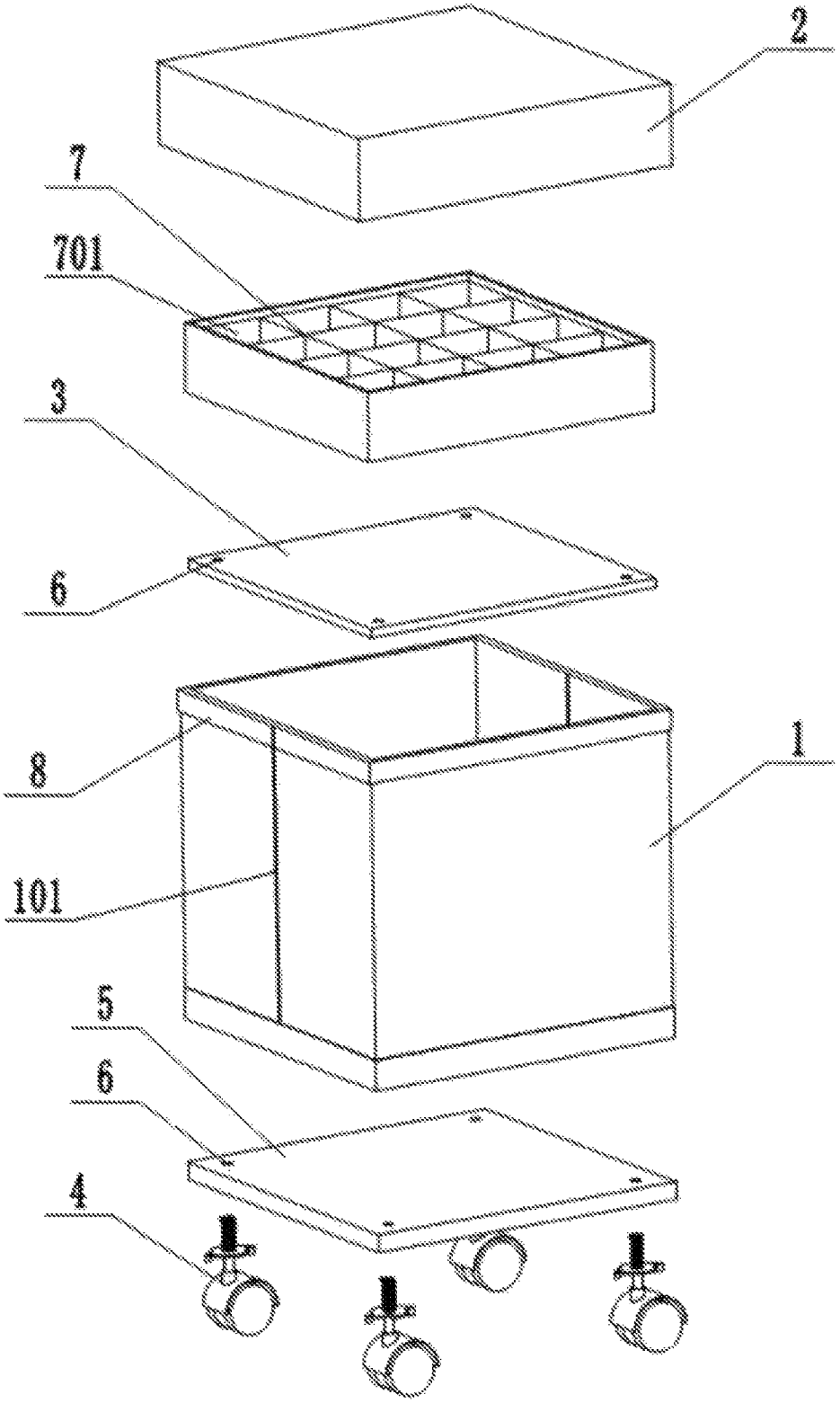
FIG. 4 is an exploded view of the folding storage stool according to the present invention.
Figure 5:
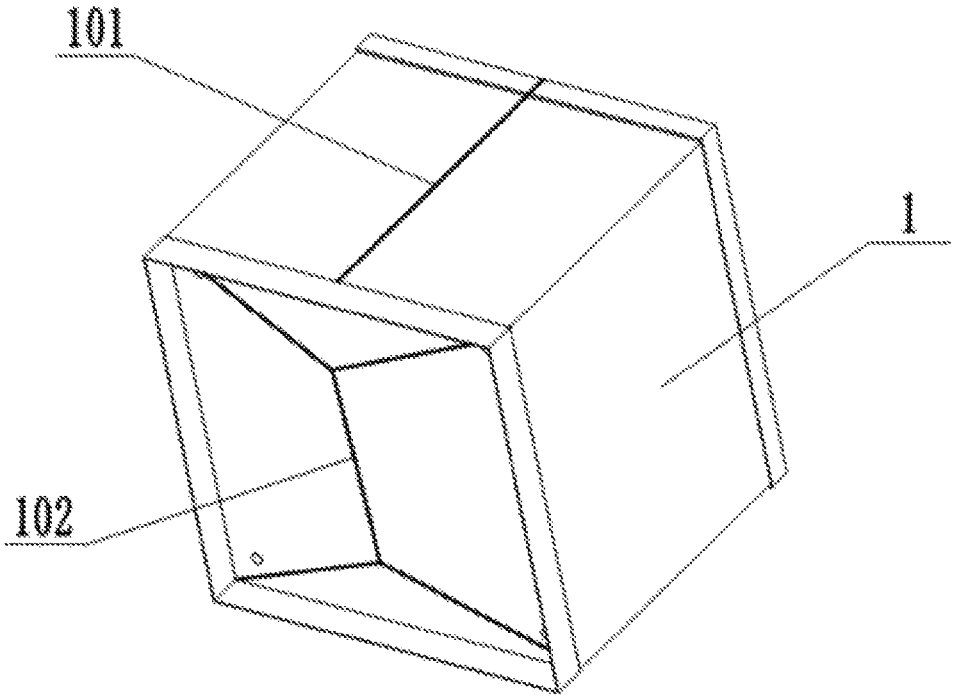
FIG. 5 is a perspective view of a stool body of the present invention.
Figure 6:
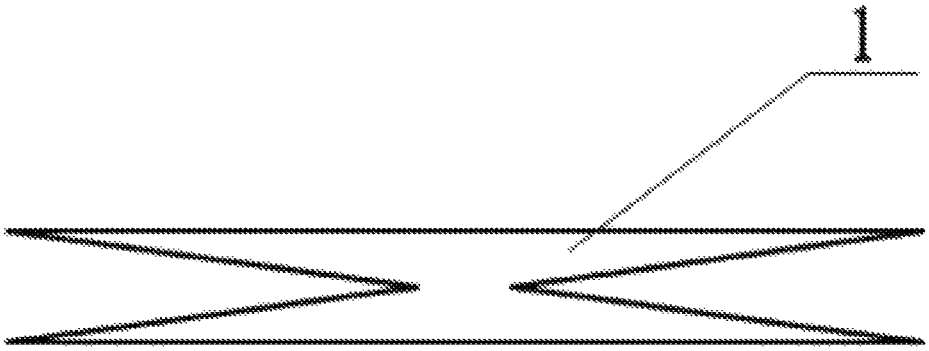
FIG. 6 is a view showing the stool body in a folded state according to the present invention.

As shown in FIG. 1, the folding storage stool on wheels in the present embodiment includes a foldable stool body 1, a cover 2 for covering an upper opening of the foldable stool body in an unfolded state, and an inner support plate 3 for supporting the foldable stool body 1, which is arranged on a bottom of an inner cavity of the foldable stool body 1 in an unfolded state, as shown in FIGS. 4-5. A side fold 101 is provided on middle of each of two opposite sides of the foldable stool body 1. A bottom fold 102 that is inwardly folded is provided at a bottom surface of the foldable stool body 1. After the inner support plate 3 is removed from the foldable stool body 1, the two opposite sides with side folds 101 are folded inwardly along the side folds 101 and the bottom surface is folded along the bottom fold 102, so that a folded body is formed when two opposite sides without folds are put together (see FIG. 6); and the folded body and the inner support plate 3 are accommodated in a cavity of the cover 2.

Figure 2:
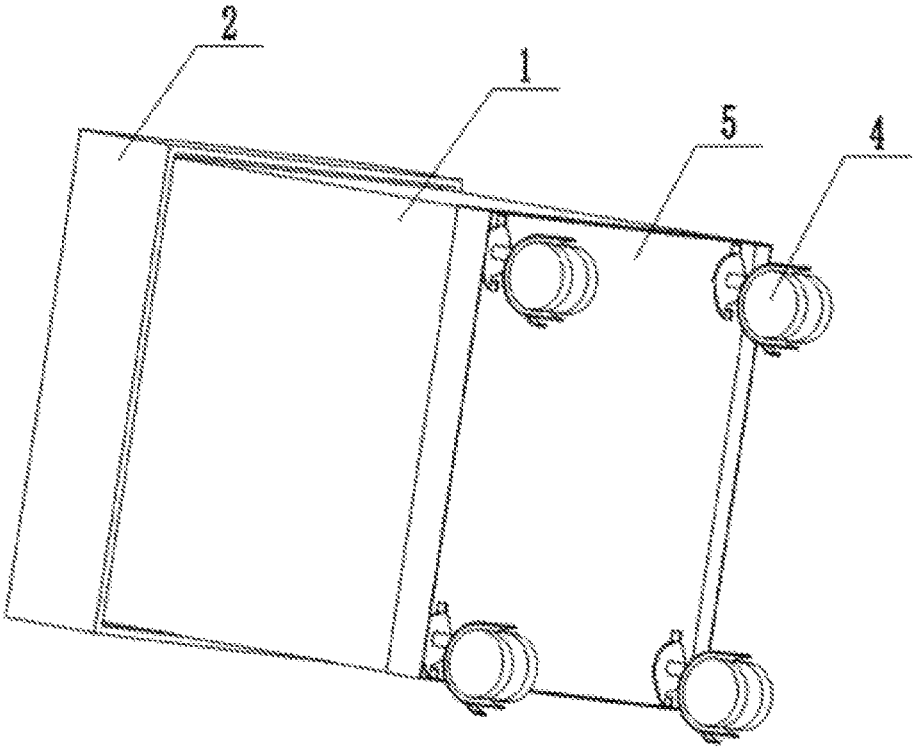
FIG. 2 is a perspective view of the folding storage stool according to the present invention.
Figure 3:
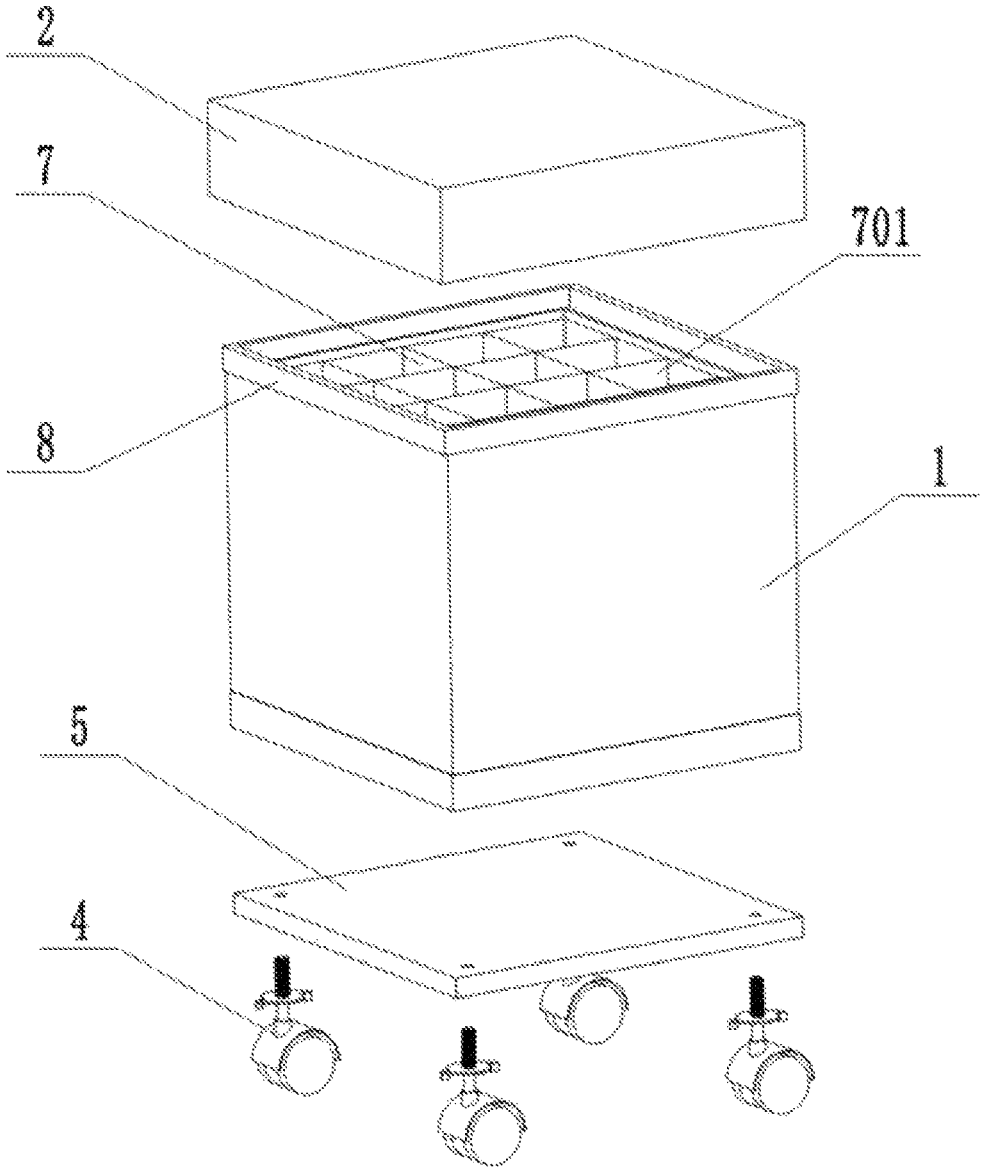
FIG. 3 is a partial exploded view of the folding storage stool according to the present invention
Figure 7:
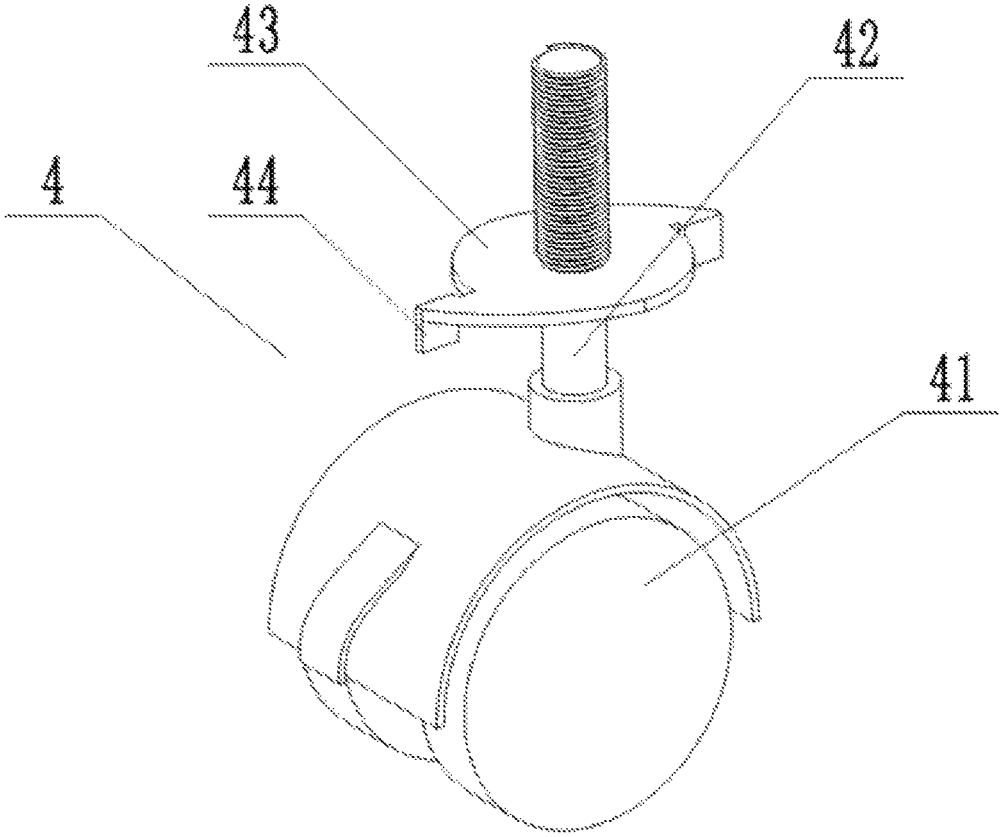
FIG. 7 is a perspective view of a movable wheel according to the present invention.
Figure 9:
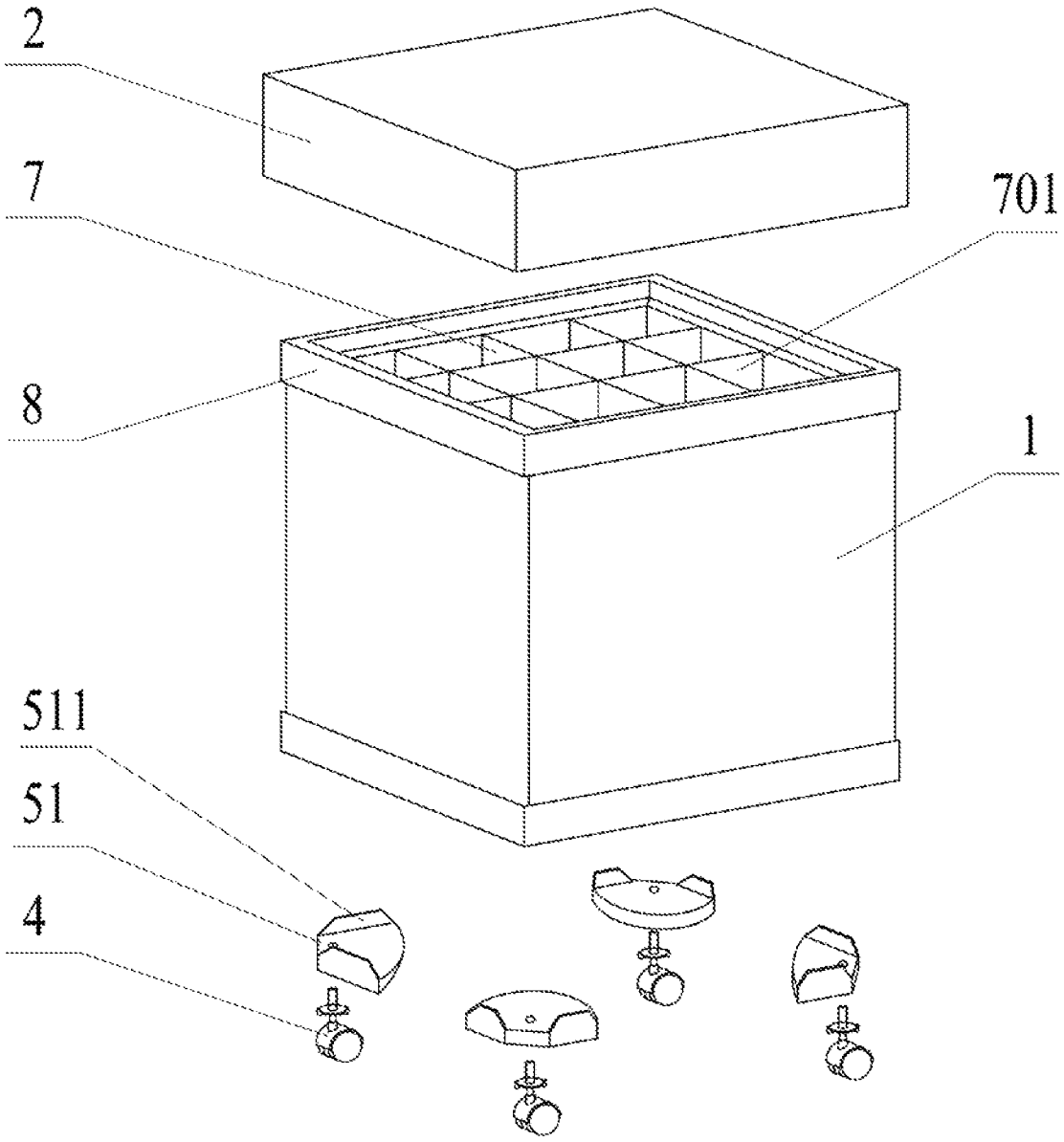
FIG. 9 shows an embodiment of an outer support plate.
Figure 10:
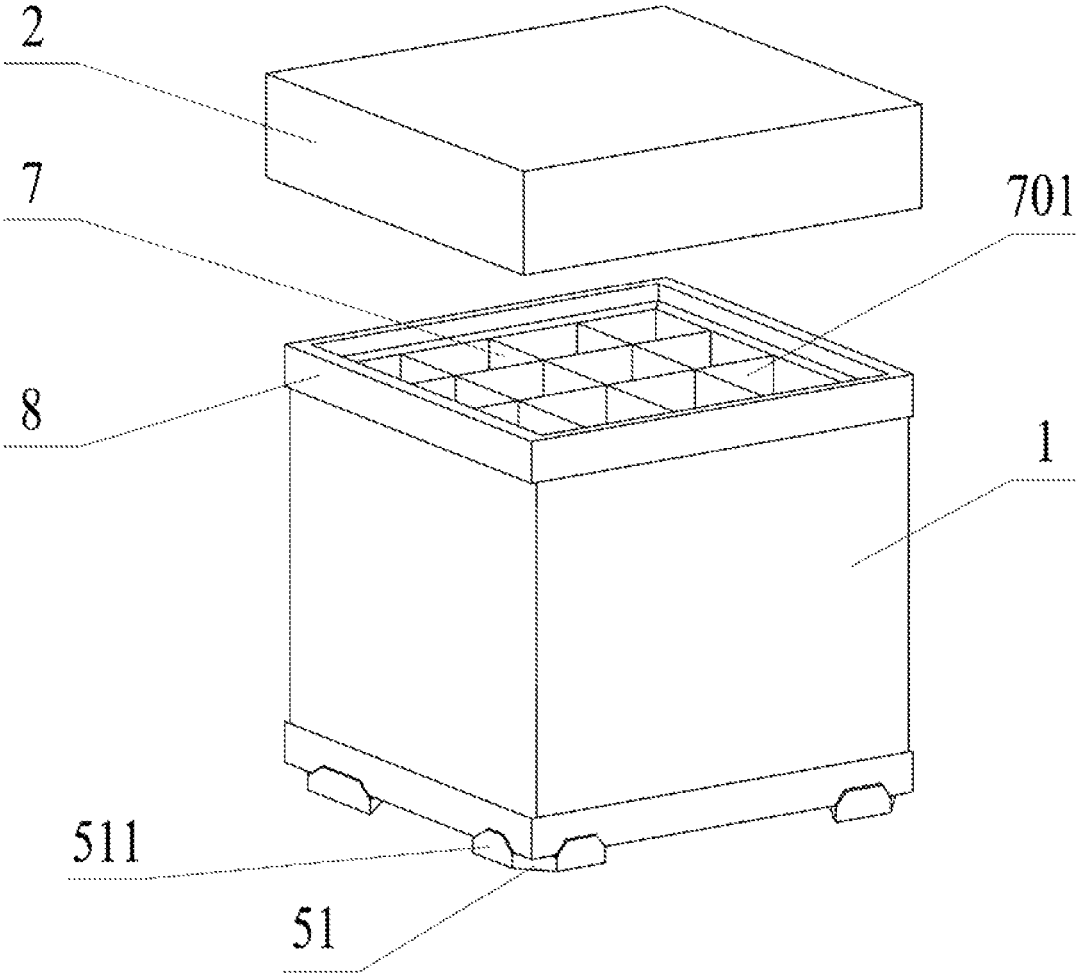
FIG. 10 is a schematic view showing sides of a bottom of the stool body provided with sectorial pads.

As shown in FIGS. 1-2, movable wheels 4 with self-locking function are arranged on a bottom of the foldable stool body 1 in an unfolded state. There are various connections between the movable wheels 4 and the foldable stool body 1. An embodiment of an outer support plate 5 is shown in FIGS. 3-4. In this embodiment, the outer support plate 5 is arranged on the bottom of the foldable stool body 1 in an unfolded state; the outer support plate 5 is a one-piece square having a length and a width greater than that of the bottom of the foldable stool body 1 in a folded state, so that four sides of the foldable stool body 1 are supported by the outer support plate 5. As shown in FIGS. 9-10, another embodiment of the outer support plate 5 is illustrated. The outer support plate 5 provided with movable wheel 4 is a sectorial pad 51, and four sectorial pads are respectively provided at four corners of the bottom of the foldable stool body in a unfolded state. The sectorial pad is provided with an L-shaped flanging that partially abuts against a side of the bottom of the foldable stool body. As shown in FIG. 7, the movable wheel 4 includes the wheel body 41 and the wheel rod 42 which is movably arranged on the wheel body 41. As shown in FIG. 4, mounting holes 6 are positioned on the outer support plate 5 and the inner support plate 3. The wheel rod 42 is screwed into the mounting hole 6 and connects the outer support plate 5 and the inner support plate 3. When the movable wheels 4 are disassembled from the foldable stool body 1, the outer support plate 5 and the inner support plate 3 are separated. The inner support plate, the outer support plate and the foldable stool body are accommodated in the cover 2 after the foldable stool body is folded.

Figure 8:
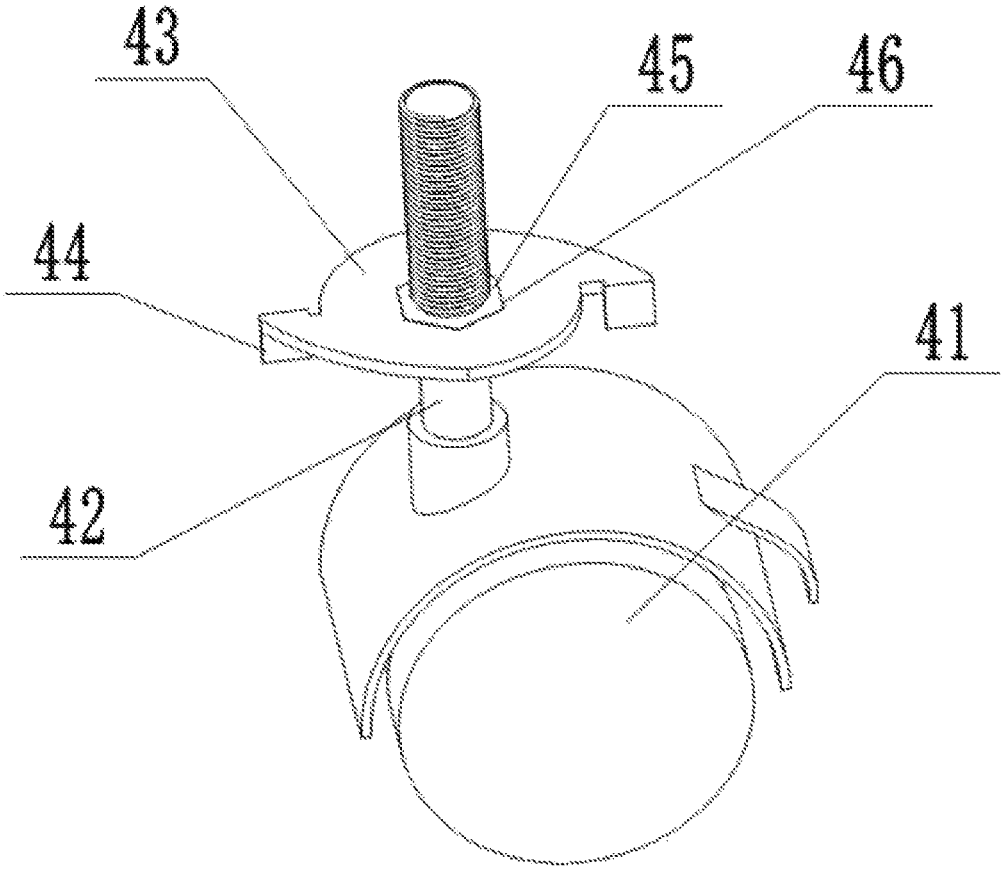
FIG. 8 is a perspective view of another movable wheel according to the present invention.

For the purpose of quick assembly and disassembly the movable wheel 4, as shown in FIGS. 7-8, a dial piece 43 is fixedly arranged on the wheel rod 42. Both ends of the dial piece 43 are respectively provided with a dial block 44 bent toward the wheel body 41. The wheel rod 42 is screwed onto the outer support plate or unscrewed from the outer support plate 5 by means of the dial piece 43. As shown in FIG. 7, the dial piece 43 is directly welded on the wheel rod 42. As shown in FIG. 8, a polygonal gasket 45 such as a hexagonal gasket is firstly welded to the wheel rod 42, and a polygonal hole 46 fitted with the polygonal gasket 45 is provided at the middle of the dial piece 43. There is an interference fit or a transition fit between the polygonal gasket 45 and the polygonal hole 46.

The movable wheels 4 may be directly screwed onto the inner support plate 3. The wheel rod 42 is screwed onto the inner support plate 3 or unscrewed from the inner support plate 3 by means of the dial piece 43.

To improve the practicability of the stool, a frame 7 is provided in the foldable stool 1 in an unfolded state, and a plurality of compartments 701 are provided in the frame 7. The upper edge of the foldable stool body 1 is provided with an adhesive strip 8 to which a hook-and-loop fastener is attached. The frame 7 is fixed to the foldable stool body 1 via the hook-and-loop fastener and the adhesive strip 8.

As shown in FIGS. 1 and 5, a plurality of covering strips are attached around the bottom of the foldable stool body 1 to cover the outer support plate 5 for the beauty of the stool.

It should be understood that for ordinary skill in the art, improvements or variations can be made based on the above descriptions, and such improvements and variations fall within the scope of the appended claims.

The embodiments are only illustrative of the present disclosure, and apparently the implementations are not limited by the above modes. The embodiments described herein and various modifications based on the ideas and technical solutions of the present disclosure fall within the scope of the present application.

What is claimed is:

1. A folding storage stool on wheels, comprising:

a foldable stool body;

a cover for covering an upper opening of the foldable stool body in an unfolded state;

an inner support plate for supporting the foldable stool body, which is arranged on a bottom of an inner cavity of the foldable stool body in an unfolded state; and a plurality of movable wheels arranged at a bottom of the foldable stool body in an unfolded state;

wherein a side fold is provided on a middle of each of two opposite sides of the foldable stool body; a bottom fold that is inwardly folded is provided at a bottom surface of the foldable stool body;

wherein, after the inner support plate is removed from the foldable stool body, the two opposite sides with side folds are folded inwardly along the side folds and the bottom surface of the foldable stool body is folded along the bottom fold, so that a folded body is formed when two opposite sides without side folds are put together; the folded body and the inner support plate are accommodated in a cavity of the cover; and wherein an outer support plate is arranged at the bottom of the foldable stool body in an unfolded state; and the plurality of movable wheels are arranged on the outer support plate.

2. The folding storage stool on wheels of claim 1, wherein the outer support plate is fixedly connected to the inner support plate.

3. The folding storage stool on wheels of claim 2, wherein each of the plurality of movable wheels comprises:

a wheel body, and wheel rods movably arranged on the wheel body;

wherein a plurality of mounting holes are positioned on the outer support plate and the inner support plate; and each wheel rod is screwed into one of the mounting holes and connects the outer support plate and the inner support plate.

4. The folding storage stool on wheels of claim 3, wherein a dial piece is fixedly arranged on the wheel rod so that the wheel rod is screwed onto the outer support plate or unscrewed from the outer support plate by means of the dial piece.

5. The folding storage stool on wheels of claim 4, wherein both ends of the dial piece are respectively provided with a dial block bent toward a side of the wheel body.

6. The folding storage stool on wheels of claim 1, wherein the outer support plate is a one-piece square having a length and a width greater than that of the bottom of the foldable stool body in an unfolded state.

7. The folding storage stool on wheels of claim 1, wherein the outer support plate comprises four sectorial pads which are respectively provided at four corners of the bottom of the stool body in an unfolded state.

8. The folding storage stool on wheels of claim 7, wherein the inner support plate is fixedly connected to the four sectorial pads.

9. The folding storage stool on wheels of claim 8, wherein each of the plurality of movable wheels comprises:

a wheel body, and a wheel rod movably arranged on the wheel body;

wherein a plurality of mounting holes are positioned on the outer support plate and the inner support plate; and the wheel rod is screwed into the mounting holes and connects the outer support plate and the inner support plate.

10. The folding storage stool on wheels of claim 9, wherein a dial piece is fixedly arranged on the wheel rod so that the wheel rod is screwed onto the outer support plate or unscrewed from the outer support plate by means of the dial piece.

11. The folding storage stool on wheels of claim 7, wherein the sectorial pad is provided with an L-shaped flanging that partially abuts against a side of the bottom of the foldable stool body.

12. A folding storage stool on wheels, comprising:

a foldable stool body;

a cover for covering an upper opening of the foldable stool body in an unfolded state;

an inner support plate for supporting the foldable stool body, which is arranged on a bottom of an inner cavity of the foldable stool body in an unfolded state; and a plurality of movable wheels arranged at a bottom of the foldable stool body in an unfolded state;

wherein a side fold is provided on a middle of each of two opposite sides of the foldable stool body; a bottom fold that is inwardly folded is provided at a bottom surface of the foldable stool body;

wherein, after the inner support plate is removed from the foldable stool body, the two opposite sides with side folds can be folded inwardly along the side folds and the bottom surface of the foldable stool body can be folded along the bottom fold, so that a folded body is formed when two opposite sides without side folds are put together; and the folded body and the inner support plate can be accommodated in a cavity of the cover;

wherein each of the plurality of movable wheel comprises:

a wheel body, and a wheel rod movably arranged on the wheel body;

wherein the wheel rod passes through the bottom of the foldable stool body and is screwed onto the inner support plate.

13. The folding storage stool on wheels of claim 12, wherein a dial piece is fixedly arranged on the wheel rod so that the wheel rod is screwed onto the outer support plate or unscrewed from the outer support plate by means of the dial piece.

14. The folding storage stool on wheels of claim 13, wherein both ends of the dial piece are respectively provided with a dial block bent toward the wheel body.

* * * * *